US005421542A

United States Patent [19]

Crutcher

[11] Patent Number: 5,421,542

[45] Date of Patent: Jun. 6, 1995

[54] ADJUSTABLE PLASTIC BAG DRYER

[76] Inventor: Jay L. Crutcher, 3372 Avenida de San Marcos, Santa Fe, N. Mex. 87505

[21] Appl. No.: 223,282

[22] Filed: Apr. 4, 1994

[51] Int. Cl.[6] ..... B65B 67/12

[52] U.S. Cl. ..... 248/95; D32/58

[58] Field of Search ..... 248/95, 97, 98, 99, 248/100; 34/239, 104; D32/58, 59; 135/16, 98, 99

[56] References Cited

U.S. PATENT DOCUMENTS

D. 339,667 9/1993 Fitzpatrick ..... D32/58
2,769,248 11/1956 Ashworth ..... D32/58 X
5,102,076 4/1992 North et al. ..... 248/95
5,188,244 2/1993 Hollstegge ..... 248/95 X
5,247,752 9/1993 Gyr et al. ..... 211/196 X

OTHER PUBLICATIONS

Plastic Bag Dryer, Catalog No. 51-207 by Real Goods.

*Primary Examiner*—Ramon O. Ramirez
*Attorney, Agent, or Firm*—Samuel M. Freund

[57] ABSTRACT

Adjustable plastic bag dryer. An adjustable, multi-ribbed apparatus for maintaining wet, water impermeable and semi-permeable plastic bags in an open condition for passive or active air drying thereof is described. The present apparatus provides a means for recycling used plastic bags in an inexpensive, environmentally noninvasive manner.

5 Claims, 3 Drawing Sheets

ADJUSTABLE PLASTIC BAG DRYER

BACKGROUND OF THE INVENTION

The present invention relates generally to drying racks, and more particularly to adjustable plastic storage bag dryers.

Plastic storage bags are available in varying sizes and thicknesses, and are widely employed for multiple uses. After use they are most usually discarded, but with the recent emphasis on reduction in solid waste burden, it has become increasingly popular to wash and/or rinse them for reuse. However, after washing, otherwise becoming wet on the inside, the sides of the bags tend to stick together, thereby rendering the evaporation of the remaining water a slow and unreliable process.

Turning bags inside-out improves the drying process, but may damage the ends of surfaces used for resealing the storage bags, rendering them useless. Moreover, inks or dyes used to mark the outside surfaces of the bags may then transfer from one surface to another.

Hanging open bags on commercially-available multiple peg racks does not improve the drying process significantly, since a single peg does not maintain the bag in a substantially open position, and non-adjustable, multiple-peg designs do not effectively accommodate the numerous plastic bag shapes and sizes.

In U.S. Pat. No. 5,102,076 for "Magnetically Suspended Plastic Bag Dryer," which issued to Alan S. North and Charles K. Neifeld on Apr. 7, 1992, the inventors describe a magnetically suspended rack for drying plastic bags consisting of a magnet attached to a supporting structure which is constructed as a sphere created by two hoops, one inside the other, and attached by rivets so that the inner hoop can rotate on an axis inside the outer hoop. The invention described is effective in maintaining the plastic bags in an open position for drying. However, only bags having larger dimensions than the diameter of the hoops can be accommodated. Moreover, although flat when the two hoops are coplanar, the device maintains a sizable storage dimension.

Accordingly, it is an object of the present invention to provide an apparatus for assisting the air drying process for water-impermeable and semi-permeable storage bags.

Another object of the invention is to provide an apparatus for assisting the air drying process for water-impermeable and semi-permeable storage bags which may be adjusted to accommodate bags having various sizes and shapes.

Yet another object of the invention is to provide an apparatus for assisting the air drying process for water-impermeable and semi-permeable storage bags which may be collapsed for compact storage.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects and in accordance with the purpose of the present invention, as embodied and broadly described herein, the adjustable storage bag drying apparatus hereof includes in combination a central support, means for holding and orienting the central support at one end thereof in a chosen direction, a slide member capable of being moved along the central support to a chosen position thereon and releasibly secured at that location, and two or more flexible ribs, each having one end rigidly attached to one end of the central support and the other end rigidly attached to the slide member in such a manner that the rib members are disposed substantially equally-spaced about the central support, whereby the ribs may be bowed outward from the central support a chosen amount when the slide member is moved toward the end of the central support at which the ribs are rigidly attached, in order to receive and maintain in an open condition the plastic storage bag to be dried, and whereby the rib members may be caused to lay approximately along the central support for storage when the slide member is moved in the opposite direction.

It is preferred that the central support member include a series of depressions suitable for releasibly receiving a tensioned leaf spring in the slide member, such that the position of the slide member along the central support may be adjusted by pushing the slide member along the central support.

Benefits and advantages of the present invention include the ability to recycle used water impermeable and semi-permeable plastic storage bags in a rapid, inexpensive, and environmentally noninvasive manner.

BRIEF DESCRIPTION OF THE DRAWINGS

The accompanying drawings, which are incorporated in and form a part of the specification, illustrate one embodiment of the present invention and, together with the description, serve to explain the principles of the invention.

DETAILED DESCRIPTION OF A PREFERRED EMBODIMENT OF THE INVENTION

Briefly, the present invention includes an apparatus for holding plastic storage bags in a substantially open condition such that they may be exposed to surrounding air or air blown by a drier or fan, for the purpose of drying the inside of the plastic bag.

Figure 1:
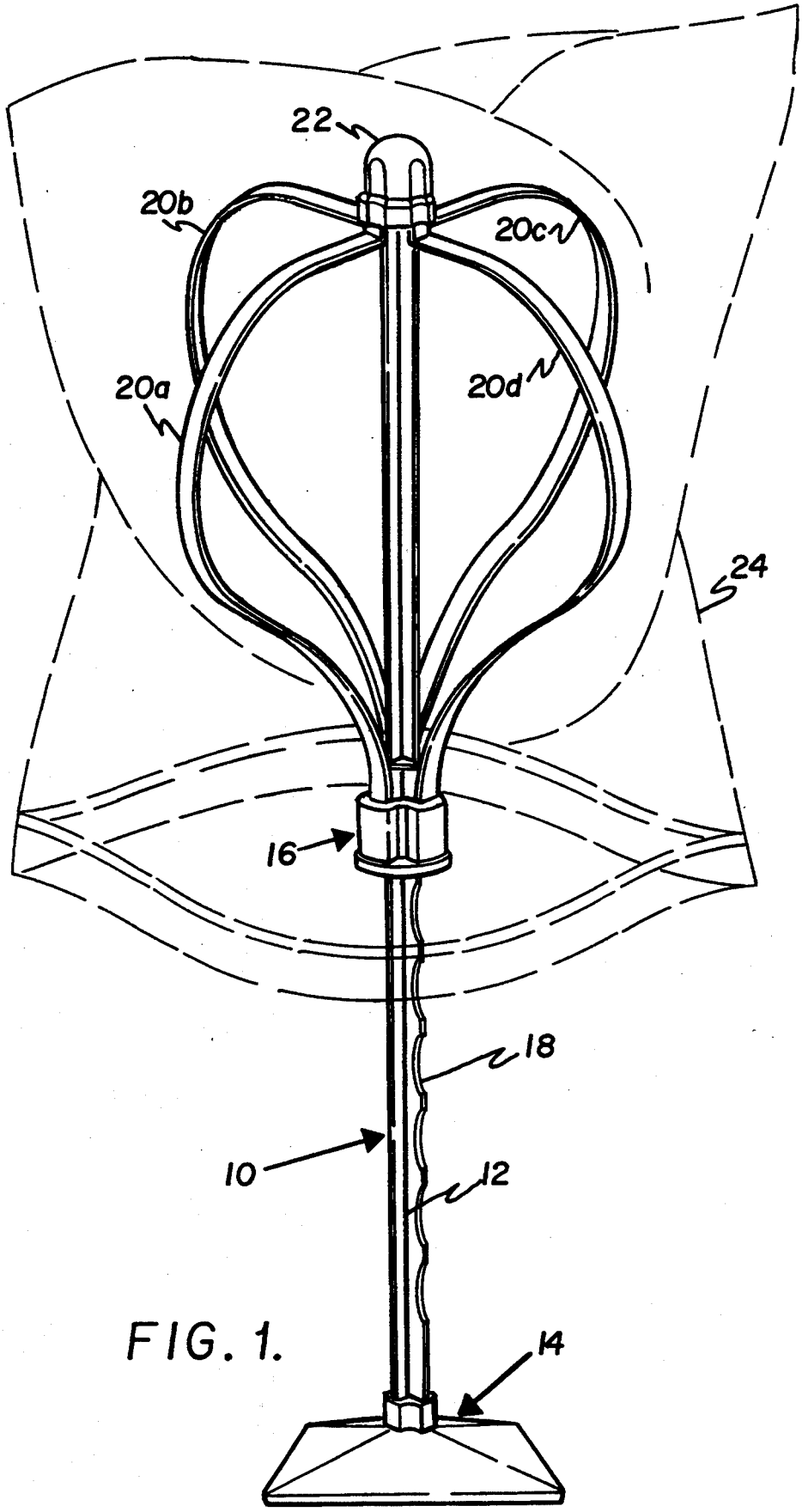
FIG. 1 shows a perspective view of the apparatus of the present invention in the deployed condition and illustrates the manner in which the flexible ribs thereof can be adjusted to hold open a plastic bag for air drying.

Reference will now be made in detail to the present preferred embodiment of the invention, and example of which is illustrated in the accompanying drawings. Turning now to the Figures, FIG. 1 is a perspective view of the present apparatus 10 illustrating its use in holding open a plastic bag for drying. Central support member 12 is attached to base 14 which, in the situation shown, holds it upright. Clearly, bases for support member 12 may be adapted to hold the support member in a variety of positions, including horizontally in the case of a wall- or cabinet-mounted base. Support member 12 is shown to have a cross-shaped cross section for preventing rotation of slide member 16, while permitting the slide member to be moved along the axis thereof, and further to improve structural strength. Depressions or notches, 18, are fashioned in the support member on at least one of legs of the cross for releasibly holding slide member 16 in a chosen position along the support, as will be further explained hereinbelow. Elongated, flexible rib members 20*a–d* are rigidly fixed to support 12 by cap member 22, which is in turn affixed to support member 12, at the other end thereof from base 14, and to slide member 16. As slide member 16 is moved along support member 12 toward cap 22, flexible ribs 20 deform outwardly. When a chosen size for, the rib assembly is attained, slide member 16 is released by the operator thereof, whereby the slide member automatically maintains its position along support 12. Plastic bag 24 may then be slipped over the deployed flexible ribs 20 for passive drying by action of the air surrounding the plastic bag, or by means of a drier or blower which directs air into the end of the plastic bag held open by the present apparatus.

Figure 2:
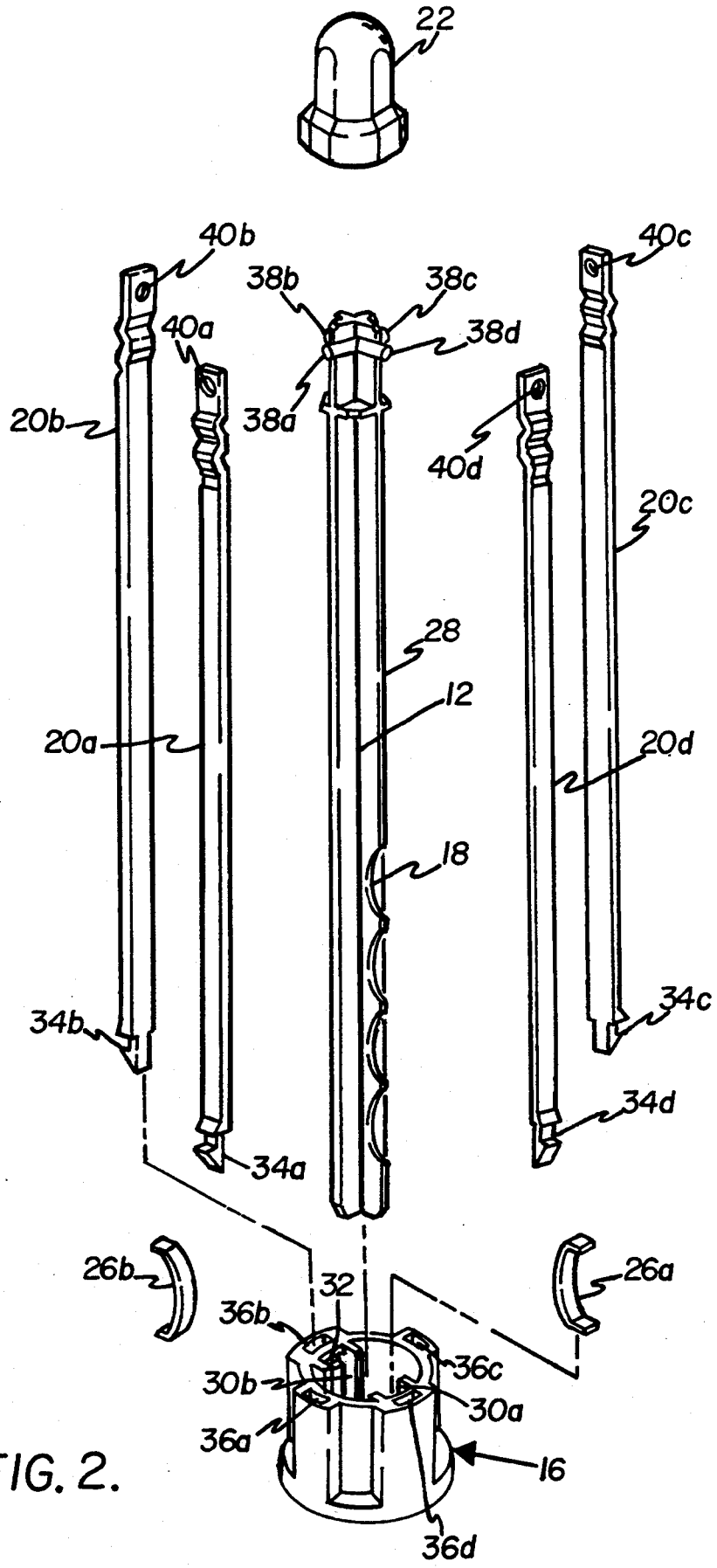
FIG. 2 shows a perspective exploded view of the apparatus shown in FIG. 1 hereof.

FIG. 2 shows an exploded view of the apparatus illustrated in FIG. 1 hereof. It is preferred that slide member 16 include at least one tensioned leaf spring member 26*a,b* such that when the slide is alongside of a depression 18 in central support member 12, the spring member expands thereinto and releasibly holds the slide member in that position. If another position is desired, the slide can be moved simply by pushing it in either direction along the support member. Spring member 26 deforms and will expand into the adjacent depression as the slide is moved alongside that depression. Shown in FIG. 2 are two leaf springs. First leaf spring, 26*a*, engages slots 18 of the support member. Second leaf spring, 26*b*, provides additional tension to ensure a more reliable positioning of the slide along support 12, or if opposing depressions to depressions 18 are provided in the colinear leg (not shown) to leg 28 of cross-shaped support 12, spring 26*b* would serve the identical function to that of spring 26*a*. Also as shown in FIG. 2, springs 26*a* and 26*b* are located in slots 30*a* and 30*b*, respectively, of slide 16, along with leg 28 and its colinear leg of support member 12, respectively. Notches, 32 are provided to hold the springs in place.

For ease of assembly, tabs 34*a–d* on ribs 20*a–d*, respectively, are adapted to be fixedly received by slots 36*a–d* in slide member 16, respectively. Posts 38*a–d* at the free end of support 12 are adapted to receive ribs 20*a–d*. Holes 40*a–d* in ribs 20*a–d* engage posts 38*a–d* thereon, respectively, and cap member 22 holds the assembly in place. Thus, ribs 20*a–d* are fixed at both ends thereof.

Figure 3:
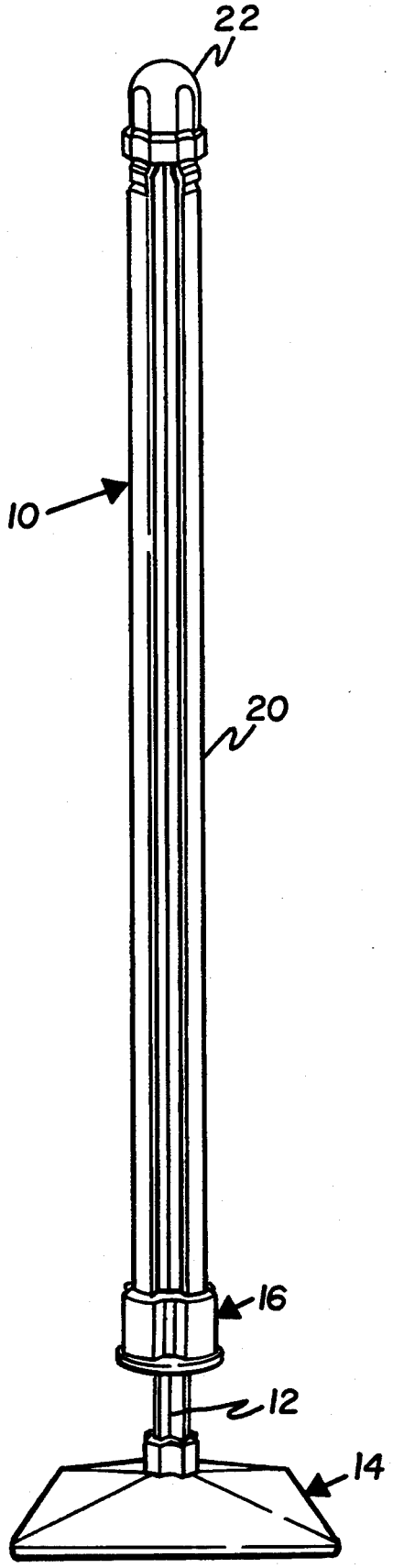
FIG. 3 shows a perspective view of the apparatus shown in FIG. 1 hereof in its closed position for storage.

FIG. 3 illustrates the present invention in its collapsed condition for storage. If base 14 is removed, the apparatus can be stored in many kitchen drawers.

The foregoing description of a preferred embodiment of the invention has been presented for purposes of illustration and description. It is not intended to be exhaustive or to limit the invention to the precise form disclosed, and obviously many modifications and variations are possible in light of the above teaching. For example, it would be apparent to one having skill in the art after studying the present disclosure that a slide member having hand-operated set screw could be utilized in place of the spring-loaded slide member described hereinabove. Moreover, a deformable slide member might be employed, whereby the position thereof along the central support member could be adjusted by squeezing the member, moving it, and then permitting it to return to its original shape, which releasibly holds to the central support member at the chosen position. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. An adjustable plastic bag drying apparatus, which comprises in combination:

a. a central support member having one free end;

b. means for releasibly receiving and holding the free end of said central support member and for orienting said central support member in a chosen direction;

c. a slide member adapted for being slidably moved along said central support member, and for releasibly maintaining a chosen position thereon; and d. at least two flexible elongated rib members, each of said flexible rib members having one end thereof rigidly attached to said central support member in the vicinity of the end thereof away from the free end, and the other end of said flexible rib members being rigidly attached to said slide member in such a manner that said rib members are disposed substantially equally-spaced about said central support member; whereby the portion of said flexible rib members between the ends thereof is adjustably deployed away from said central support member as said slide member is moved toward the end of said central support member away from the free end thereof from a position along said central support member where said at least two flexible rib members are disposed substantially parallel to said central support member, in order to reversibly receive and maintain in an open condition the plastic bag to be dried.

2. The adjustable plastic bag drying apparatus as described in claim 1, further comprising a tensioned leaf spring located in said slide member, and wherein said central support member includes a series of depressions suitable for releasibly receiving said tensioned leaf spring, such that the position of said slide member along said central support member may be adjusted by pushing said slide member along said central support member.

3. The adjustable plastic bag drying apparatus as described in claim 1, wherein said slide member is deformable such that when said slide member is deformed, the position thereof along said central support member may be reversibly changed.

4. The adjustable plastic bag drying apparatus as described in claim 1, wherein said slide member further comprises a set screw for engaging said central support member, whereby said slide member may be releasibly located along said central support member.

5. The adjustable plastic bag drying apparatus as described in claim 1, further comprising air moving means for directing a stream of air into the opening of the plastic bag to be dried.

* * * * *